US009149827B2

(12) United States Patent
Anuskiewicz

(10) Patent No.: US 9,149,827 B2
(45) Date of Patent: Oct. 6, 2015

(54) POP-UP IRRIGATION SPRINKLER WITH SHOCK ABSORBING RISER RETRACTION SPRINGS

(71) Applicant: Ronald H. Anuskiewicz, San Diego, CA (US)

(72) Inventor: Ronald H. Anuskiewicz, San Diego, CA (US)

(73) Assignee: HUNTER INDUSTRIES, INC., San Marcos, CA (US)

( * ) Notice: Subject to any disclaimer, the term of this patent is extended or adjusted under 35 U.S.C. 154(b) by 109 days.

(21) Appl. No.: 13/785,577

(22) Filed: Mar. 5, 2013

(65) Prior Publication Data

US 2014/0252123 A1 Sep. 11, 2014

(51) Int. Cl.
*B05B 15/10* (2006.01)
*B05B 3/04* (2006.01)

(52) U.S. Cl.
CPC ..... *B05B 15/10* (2013.01); *B05B 3/0422* (2013.01)

(58) Field of Classification Search
CPC ..... B05B 15/10; B05B 3/021; B05B 3/0422
USPC ..... 239/201, 203–206, 237, 240, 242
See application file for complete search history.

(56) References Cited

U.S. PATENT DOCUMENTS 5,058,806 A 10/1991 Rupar
5,288,022 A 2/1994 Sesser
5,375,768 A 12/1994 Clark
5,423,486 A 6/1995 Hunter
5,456,411 A 10/1995 Scott et al.
5,556,036 A 9/1996 Chase
5,699,962 A 12/1997 Scott et al.
5,711,486 A 1/1998 Clark et al.
5,720,435 A 2/1998 Hunter
5,762,270 A 6/1998 Kearby et al.
5,823,439 A * 10/1998 Hunter et al. ..... 239/205
5,823,440 A 10/1998 Clark ..... 239/206
5,918,812 A * 7/1999 Beutler ..... 239/205
5,927,607 A 7/1999 Scott
5,988,523 A 11/1999 Scott ..... 239/114
6,042,021 A 3/2000 Clark
6,050,502 A 4/2000 Clark
6,082,632 A 7/2000 Clark et al.
6,138,924 A 10/2000 Hunter et al.
6,227,455 B1 5/2001 Scott et al. ..... 239/1
6,241,158 B1 6/2001 Clark et al.
6,244,521 B1 6/2001 Sesser
6,299,075 B1 10/2001 Koller
6,301,723 B1 * 10/2001 Goettl ..... 4/490
6,439,476 B1 * 8/2002 Boggs ..... 239/203
6,457,656 B1 10/2002 Scott
6,491,235 B1 12/2002 Scott et al. ..... 239/206
6,499,672 B1 12/2002 Sesser
6,651,905 B2 11/2003 Sesser et al.

(Continued)

*Primary Examiner* — Arthur O Hall
*Assistant Examiner* — Juan C Barrera
(74) *Attorney, Agent, or Firm* — Knobbe Martens Olson & Bear LLP

(57) ABSTRACT

An irrigation sprinkler includes an outer case, a riser telescopically extensible from the outer case, and a nozzle at an upper end of the riser. A coil spring surrounds the riser and normally holds the riser in a lower retracted position within the outer case. The coil spring is dimensioned and configured to permit extension of the riser to a raised upper position when pressurized water is introduced into the outer case. A shock absorber is positioned between a lower end of the riser and a rigid structure in the lower end of case for lessening the forces otherwise exerted on the riser during rapid retraction of the riser.

22 Claims, 10 Drawing Sheets

(56) References Cited

U.S. PATENT DOCUMENTS

| | | | | |
|---|---|---|---|---|
| 6,688,539 | B2 | 2/2004 | Vander Griend | |
| 6,695,223 | B2 | 2/2004 | Beutler et al. | |
| 6,736,332 | B2 | 5/2004 | Sesser et al. | |
| 6,817,543 | B2 | 11/2004 | Clark | |
| 6,854,664 | B2 | 2/2005 | Smith | |
| 6,871,795 | B2 | 3/2005 | Anuskiewicz | |
| 6,957,782 | B2 | 10/2005 | Clark et al. | |
| 7,032,836 | B2 | 4/2006 | Sesser et al. | |
| 7,040,553 | B2 | 5/2006 | Clark | |
| 7,159,795 | B2 | 1/2007 | Sesser et al. | |
| 7,240,860 | B2 | 7/2007 | Griend | |
| 7,287,711 | B2 | 10/2007 | Crooks | |
| 7,303,147 | B1 | 12/2007 | Danner et al. | 239/203 |
| 7,322,533 | B2 | 1/2008 | Grizzle | |
| D593,182 | S | 5/2009 | Anuskiewicz | |
| 7,530,504 | B1 | 5/2009 | Danner et al. | |
| 7,611,077 | B2 | 11/2009 | Sesser et al. | |
| 7,621,467 | B1 | 11/2009 | Garcia | |
| 7,677,469 | B1 | 3/2010 | Clark | 239/242 |
| 7,748,646 | B2 | 7/2010 | Clark | |
| 7,828,230 | B1 | 11/2010 | Anuskiewicz et al. | |
| 7,861,948 | B1 | 1/2011 | Crooks | |
| 8,220,723 | B2 | 7/2012 | Clark | |
| 8,272,578 | B1 | 9/2012 | Clark et al. | |
| 8,282,022 | B2 | 10/2012 | Porter | |
| 8,297,533 | B2 | 10/2012 | Dunn et al. | |
| 8,313,043 | B1 | 11/2012 | Crooks et al. | |
| 2005/0133619 | A1 | 6/2005 | Clark | |
| 2009/0224070 | A1 | 9/2009 | Clark et al. | |
| 2011/0024522 | A1 | 2/2011 | Anuskiewicz | |
| 2012/0024982 | A1 | 2/2012 | Dunn et al. | |
| 2012/0043398 | A1 | 2/2012 | Clark | |
| 2012/0132727 | A1 | 5/2012 | Dunn et al. | |
| 2012/0234940 | A1 | 9/2012 | Clark et al. | |
| 2012/0273593 | A1 | 11/2012 | Clark et al. | |
| 2013/0270361 | A1* | 10/2013 | Clark et al. | 239/205 |

* cited by examiner

POP-UP IRRIGATION SPRINKLER WITH SHOCK ABSORBING RISER RETRACTION SPRINGS

FIELD OF THE INVENTION

The present invention relates irrigation, and more particularly, to pop-up sprinklers for watering turf and landscaping.

BACKGROUND

The artificial distribution of water onto plants through irrigation systems is in wide use throughout the world today. Many irrigation systems are installed for watering lawns, shrubs, golf courses, and athletic fields. The typical irrigation system for such applications includes a programmable electronic irrigation controller that turns a plurality of solenoid actuated valves ON and OFF in accordance with a watering schedule. The valves deliver water through subterranean pipes to a plurality of sprinklers spaced around the irrigation site. One of the most popular sprinklers currently in use for watering golf courses and athletic fields is the pop-up rotor-type sprinkler. This sprinkler includes a vertically telescoping cylindrical riser that is normally in a retracted position within an outer cylindrical case whose flanged upper end is flush with the surface of the ground. The riser is surrounded by a coil spring that holds the riser in its lowered position within the outer case. When the water to the sprinkler is turned ON, the riser telescopes to its raised position. The riser contains a turbine that drives a nozzle turret through a gear train reduction. The riser also usually contains a reversing mechanism that is manually adjustable to set the arc of oscillation of the nozzle turret. Some rotor-type sprinklers can be set to a full circle rotation mode. Large rotor-type sprinklers sometimes include an ON/OFF valve in the lower portion of the outer case. These sprinklers are referred to as valve-in-head sprinklers.

Rotor-type sprinklers that are used on golf courses and playing fields often eject a stream of water seventy feet or more. These sprinklers sometimes operate at water pressures above one-hundred pounds per square inch. They are subjected to extreme forces over their lifetime of use which can damage them and reduce their useful life. The most serious of these forces results from water hammer and high pressure surges that occur during system winterization and spring recharge. Winterizing involves blowing high pressure air through the pipes to remove the water to prevent damage to the sprinklers from water freezing in the sprinklers. In the spring, high pressure water is re-introduced into the pipes that lead to the sprinklers. The high impact forces experienced by a pop-up rotor type sprinkler are especially prevalent when an empty pipe is being filled with water at a high water pressure. Slugs of water separated by air pockets accelerate down the length of the pipe, and rapidly open the valve in the bottom of the outer case and slam the lower end of the riser to the end of its stroke against a retaining ring positioned at the upper end of the outer case. Due to the high water pressures and large pipe sizes for large turf applications these forces can be extremely high and frequently cause damage to the gear train reduction, reversing mechanism, and other delicate parts of the sprinkler. This often necessitates removal and replacement of the riser. In some cases, the entire sprinkler must be dug out of the ground and replaced. This is especially difficult and inconvenient on a golf course.

Hunter Industries, Inc., the assignee of the subject application, has obtained several patents disclosing sprinkler that are constructed to minimize damage due to rapid extension of the riser. See U.S. Pat. Nos. 5,823,439; 5,823,440 and 5,918,812. See also U.S. patent application Ser. No. 13/445,055 filed Apr. 12, 2012, of Michael L. Clark et al. entitled "POP-UP IRRIGATION SPRINKLER WITH SHOCK ABSORBING RISER DAMPING CUSHION."

Heretofore the problem of sprinkler damage due to rapid retraction of the riser has not been solved.

SUMMARY

In accordance with the present invention an irrigation sprinkler includes an outer case, a riser telescopically extensible from the outer case, and a nozzle at an upper end of the riser. A coil spring surrounds the riser and normally holds the riser in a lower retracted position within the outer case. The coil spring is dimensioned and configured to permit extension of the riser to a raised upper position when pressurized water is introduced into the outer case. A shock absorber is positioned between a lower end of the riser and a rigid structure in the lower end of case for lessening the forces otherwise exerted on the riser during rapid retraction of the riser.

BRIEF DESCRIPTION OF THE DRAWINGS

FIG. 3 is a view similar to FIG. 2 except that the riser assembly is shown it its further retracted position caused by high speed retraction. In this view the spring fingers at the lower end of the riser assembly have been deflected upwardly to absorb the shock that the riser assembly would otherwise be subjected to.

Throughout the drawing figures, like reference numerals refer to like parts.

DETAILED DESCRIPTION

The present invention provides a rotor-type sprinkler with a novel shock absorbing mechanism that reduces or eliminates the substantial impact forces encountered during rapid retraction of the riser assembly in order to provide the sprinkler with a longer useful life.

Figure 1:
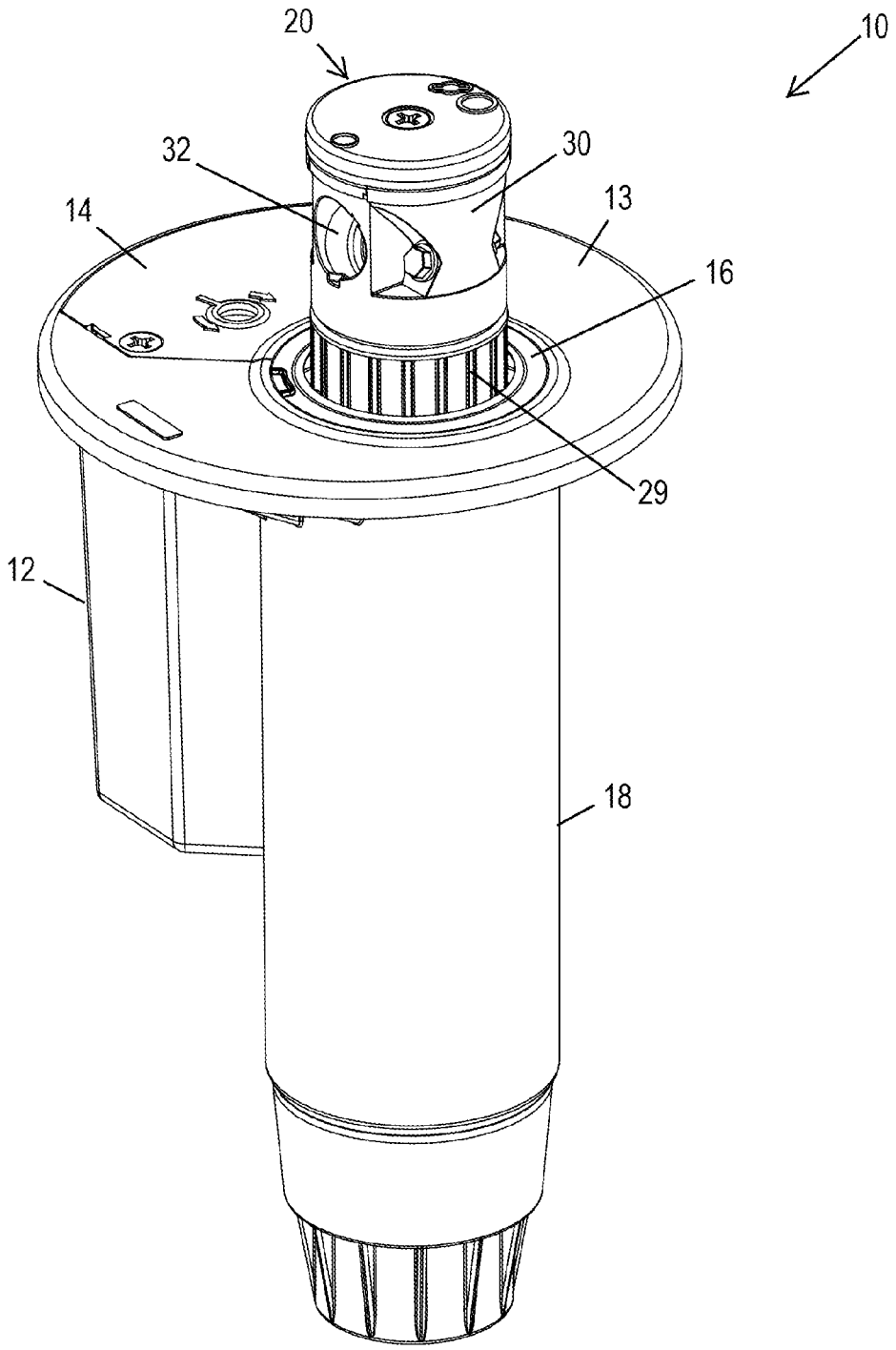
FIG. 1 is an isometric view of a pop-up rotor-type irrigation sprinkler that can beneficially utilize the present invention.

Referring to FIG. 1, a pop-up rotor-type irrigation sprinkler 10 includes a generally rectangular housing 12 that is sized and configured to hold control components. A large horizontal disc-shaped flange 13 at the upper end of the sprinkler 10 has an aperture sealed with a removable cover 14 that facilitates access to the components in the housing 12 for servicing. A snap ring 16 fits into a snap ring groove 17 (FIG. 2) formed on an inner diameter of a generally cylindrical outer case 18. The housing 12, flange 13 and case 18 are preferably injection molded as one integral unit out of a suitable hard black colored plastic material such as acrylonitrile butadiene styrene (ABS) plastic the includes chemical additives to resist degradation from ultraviolet (UV) radiation from the sun. The cover 14 is preferably molded out of the same ABS plastic. The snap ring 16 may be of the type disclosed in U.S. Pat. No. 5,988,523 of Loren Scott granted Nov. 23, 1999, and entitled "POP-UP SPRINKLER UNIT WITH SPLIT CONTAINMENT RING," assigned to Hunter Industries, Inc., the entire disclosure of which is hereby incorporated by reference.

Figure 4:
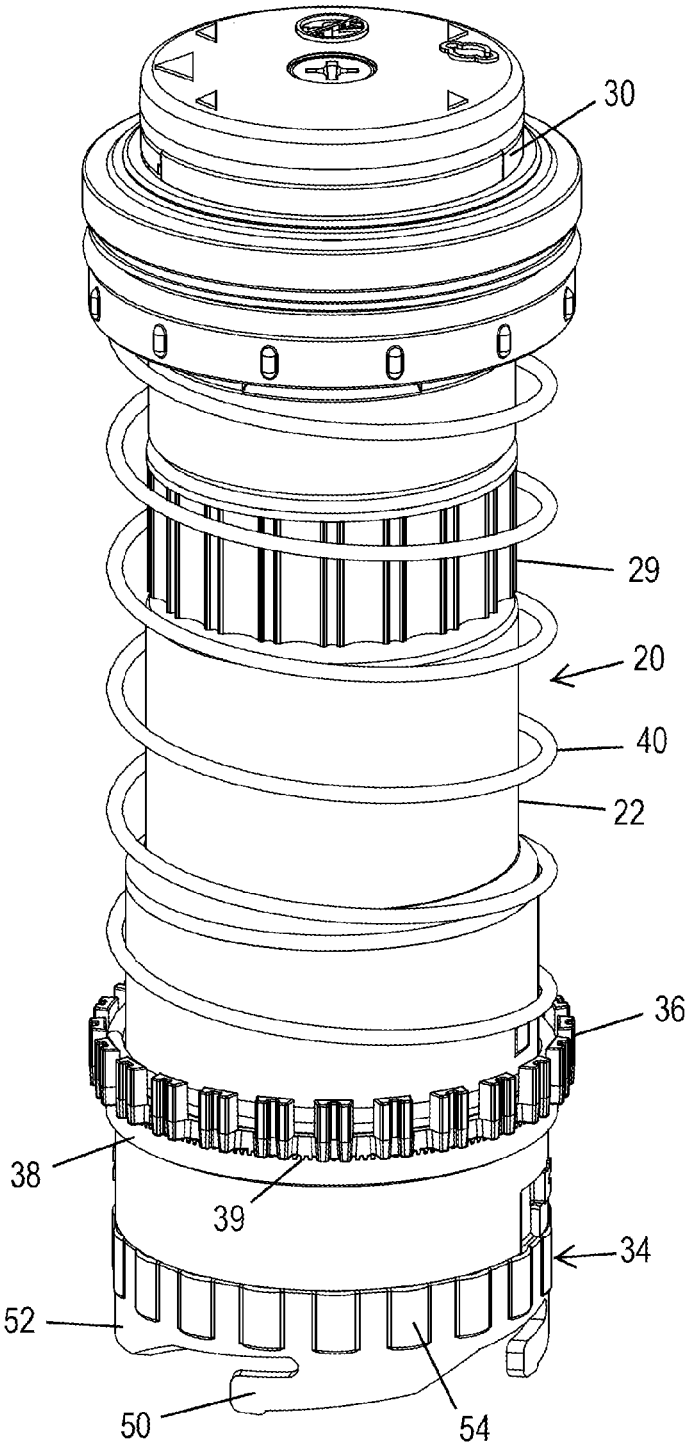
FIG. 4 is an enlarged isometric view of the riser assembly of the sprinkler of FIG. 1 and which incorporates the first embodiment of the present invention. The spring fingers are shown in their relaxed normal configuration.

The snap ring 16 (FIGS. 1 and 2) holds a telescoping riser assembly 20 (FIG. 4) securely in the case 18. The riser assembly 20 includes a cylindrical tubular riser 22 (FIG. 2) that houses the internal drive mechanisms of the sprinkler 10. These include a gear train reduction 24, a turbine 26 mounted to an input shaft of the gear train reduction 24 and rotatable by water entering the lower end of the riser 22, and a reversing mechanism 28 driven by the gear train reduction. The user can manually set an arc of coverage (typically from about forty to three hundred and sixty degrees) by rotating an arc adjustment ring 29 (FIG. 1).

Figure 2:
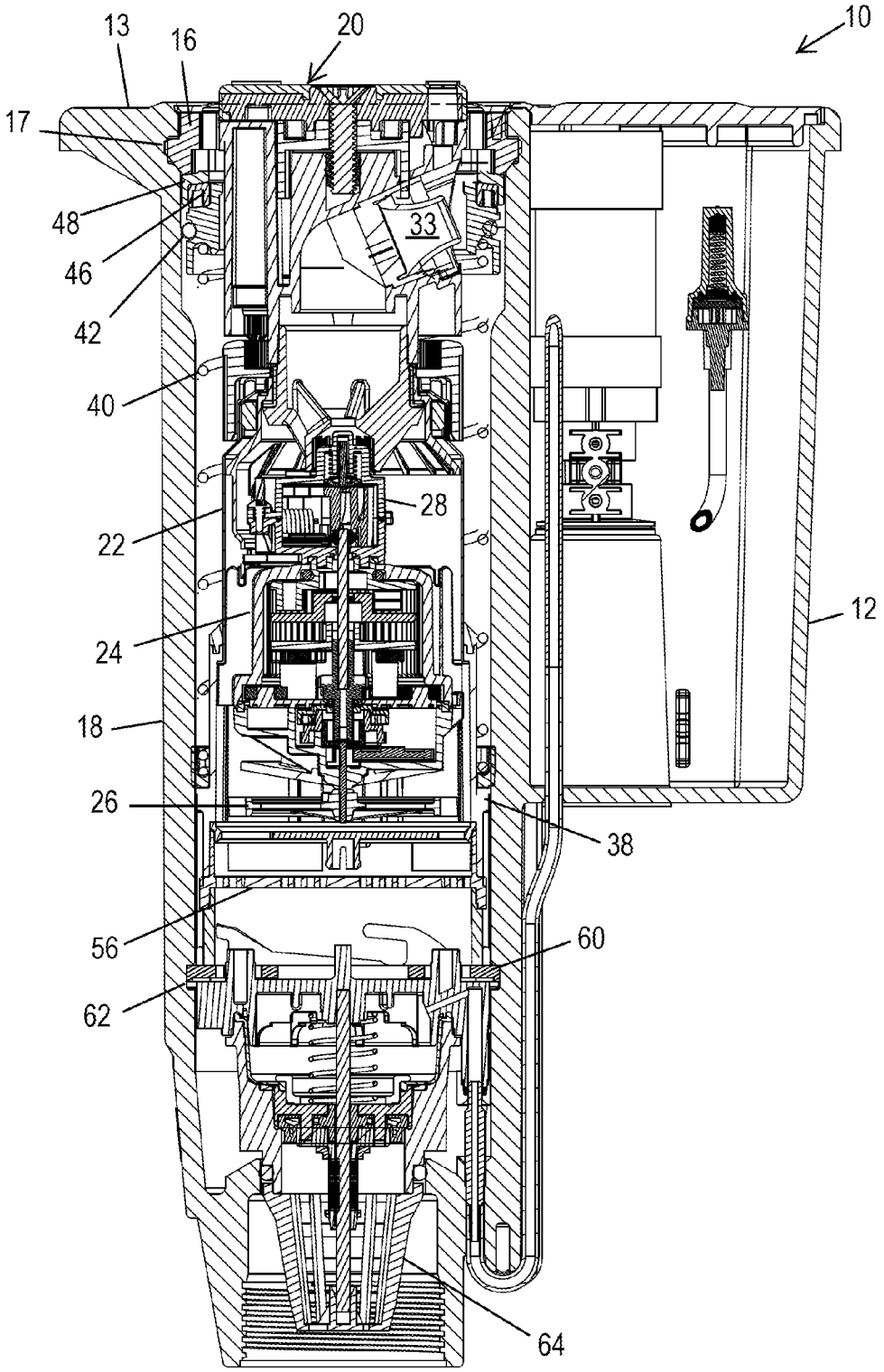
FIG. 2 is an enlarged fragmentary vertical sectional view of the sprinkler of FIG. 1 illustrating details of a first embodiment of the present invention. In this view the riser assembly of the sprinkler is in its normal at rest retracted position.

The riser assembly 20 further includes a cylindrical nozzle turret 30(FIG. 1) that is rotatably mounted at the top of the riser 22. The reversing mechanism 28 couples the gear train reduction 24 and the nozzle turret 30. The nozzle turret 30 includes a socket 32 with a removable nozzle 33 (FIG. 2). The nozzle turret 30 oscillates back and forth according to the arc set by the manual setting of the arc adjustment ring 29. The nozzle turret 30 accepts removable nozzles and nozzle plugs, as disclosed in U.S. patent application Ser. No. 13/154,698 filed by Michael L. Clark et al. on Jun. 7, 2011, and assigned to Hunter Industries, Inc. entitled "IRRIGATION SPRINKLER WITH RE-CONFIGURABLE SECONDARY NOZZLE HOLDER," the entire disclosure of which is hereby incorporated by reference.

Details of other suitable gear train reductions, reversing mechanisms, mechanisms for coupling the reversing mechanism to the nozzle turret, and arc adjusting mechanisms are disclosed in various patent applications and patents assigned to Hunter Industries, Inc. and need not be described in detail herein. See, for example, see U.S. patent application Ser. No. 13/343,522 filed Jan. 4, 2012, by Michael L. Clark et al. assigned to Hunter Industries, Inc. entitled "ROTOR-TYPE IRRIGATION SPRINKLER WITH COARSE AND FINE ARC ADJUSTMENT," the entire disclosure of which is hereby incorporated by reference. See also U.S. patent application Ser. No. 13/343,456 filed Jan. 4, 2012, by Ronald H. Anuskiewicz et al. assigned to Hunter Industries, Inc. entitled "PLANETARY GEAR DRIVE ROTOR-TYPE SPRINKLER WITH ADJUSTABLE ARC/FULL CIRCLE SELECTION MECHANISM," the entire disclosure of which is hereby incorporated by reference. See also U.S. Pat. No. 7,677,469 of Michael L. Clark granted Mar. 16, 2010, assigned to Hunter Industries, Inc. entitled "SPRINKLER WITH REVERSING PLANETARY GEAR DRIVE," the entire disclosure of which is hereby incorporated by reference. See also U.S. Pat. No. 6,227,455 of Scott et al. granted May 8, 2001, assigned to Hunter Industries, Inc. entitled "SUB-SURFACE SPRINKLER WITH SURFACE ACCESSIBLE VALVE ACTUATOR COMPONENTS," the entire disclosure of which is hereby incorporated. See also U.S. Pat. No. 6,491,235 of Scott et al. granted Dec. 10, 2002, assigned to Hunter Industries, Inc. entitled "POP-UP SPRINKLER WITH TOP SERVICEABLE DIAPHRAGM VALVE MODULE," the entire disclosure of which is hereby incorporated.

A generally cylindrical rock screen 34 (FIGS. 6 and 7) is removably mounted to the lower end of the riser 22 to prevent large particulate contaminates from entering the riser 22. See U.S. patent application Ser. No. 13/168,822 filed by Ronald H. Anuskiewicz on Jun. 24, 2011, assigned to Hunter Industries, Inc. entitled "IRRIGATION SPRINKLER WITH TWIST-AND-LOCK DEBRIS SCREEN," the entire disclosure of which is hereby incorporated by reference. A lower ring-shaped spring seat 36 (FIG. 4) slides over an outer diameter of the riser 22 and sits on a radially outwardly extending flange 38 (FIG. 2) molded into the lower end of the riser 22. The spring seat 36 supports the lower end of a stainless steel coil spring 40. The coil spring 40 surrounds the riser 22 and normally holds the riser assembly 20 in a retracted position inside the outer case 18. The riser assembly 20 vertically reciprocates through a circular aperture in the disc-shaped flange 13. The flange 13 is preferably integrally molded at the upper end of the case 18. When pressurized water is supplied through an inlet at the lower end of the outer case 18 the riser assembly 20 rapidly moves upwardly relative to the case 18 in telescopic fashion to a raised upper position. During this extension of the riser assembly 20 the coil spring 40 is compressed. When the pressurized water being supplied to the inlet of the case 18 is shut off, the force of the compressed coil spring 40 pushes the riser assembly 20 back down to its lower retracted position in which the upper surface of the nozzle turret 30 is substantially flush with the upper side of the flange 13 (FIG. 1).

The upper side of the flange 38 preferably includes a plurality of identical equally circumferentially spaced small teeth 39 that mesh with mating small teeth formed on the underside of the spring seat 36. This allows the user to radially adjust the position of riser assembly 20 relative to the outer case 18 without removing the riser assembly 20 from the outer case 18. An upper spring seat 42 (FIGS. 2 and 3), an O-ring 44, a ring-shaped cushion 46 and an upper ring-shaped shield 48 combine to provide a shock absorbing structure that absorbs the shock of the impact that occurs when the riser assembly 20 reaches its fully extended position after rapid upward vertical travel of the riser assembly 20. Further details of the structure of the riser assembly 20 that absorbs the shock on its rapid extension may be found in the aforementioned pending U.S. patent application Ser. No. 13/445,055.

Figure 5:
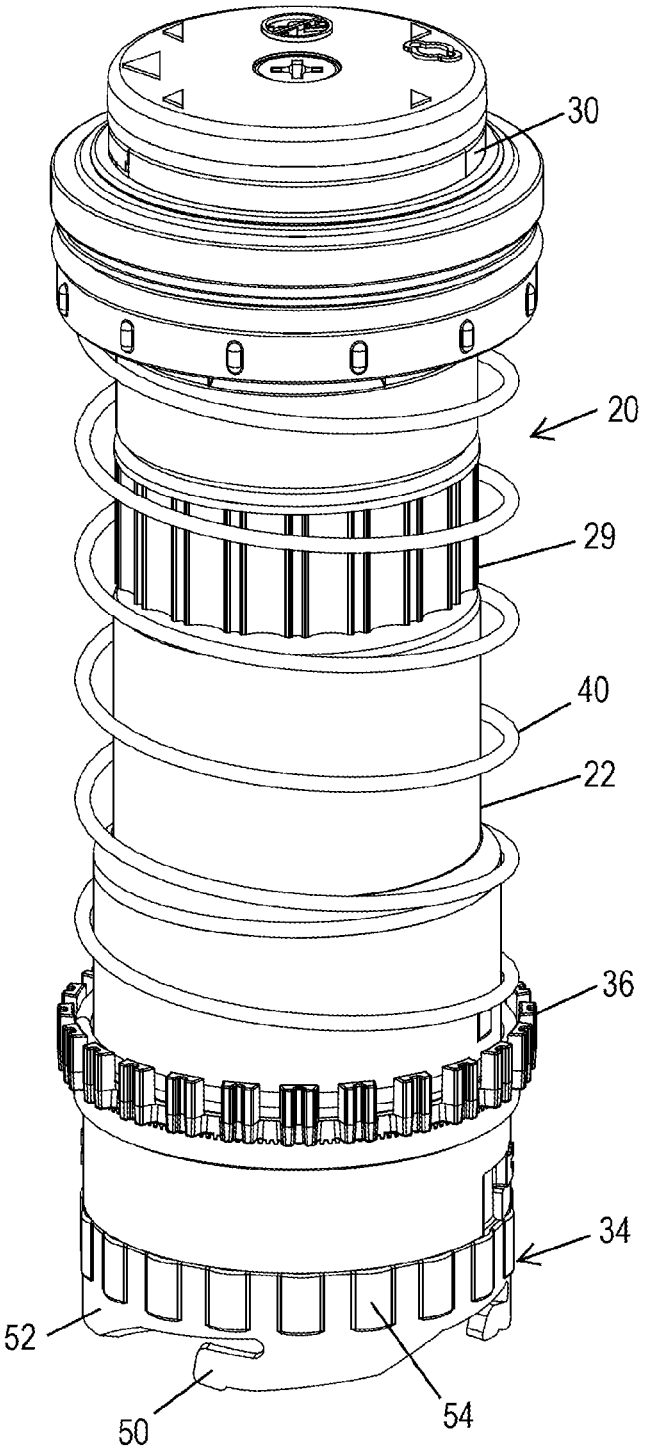
FIG. 5 is a view of the riser assembly similar to FIG. 4 showing the spring fingers in their deflected configuration which results from high speed retraction of the riser assembly within the outer case of the sprinkler.
Figure 6:
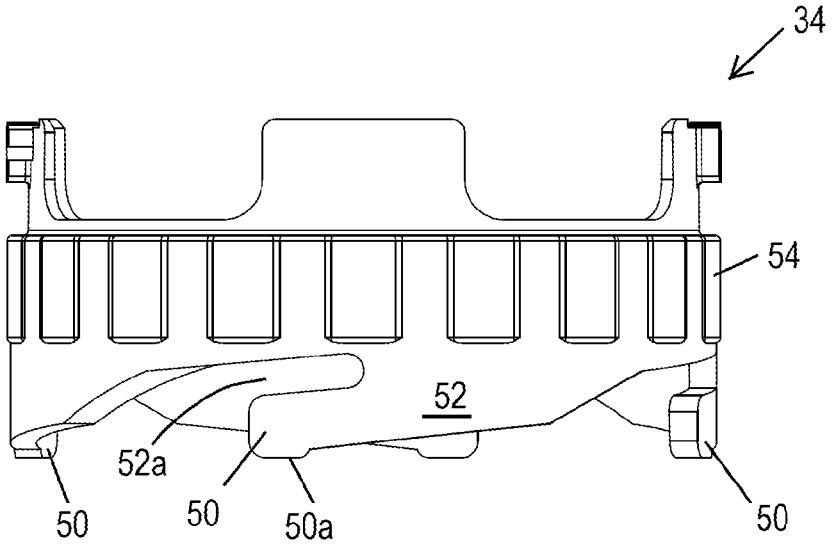
FIG. 6 is a side elevation view of cylindrical screen of the preferred embodiment which has the spring fingers integrally molded into the same. The spring fingers are shown in their relaxed normal configuration.

The rock screen 34 has four identical integrally formed spring fingers 50 (FIGS. 5 and 6). The spring fingers 50 are circumferentially uniformly spaced at ninety degree locations and are curved viewed looking down from above the sprinkler, i.e. they are essentially arcuate extensions of an axially extending vertical cylindrical wall 52 of the rock screen 34. Axially extending rectangular projections 54 circumferentially spaced around the outer surface of the rock screen 34 provide a gripping surface to facilitate manual twisting of the rock screen 34 when it is being placed on the riser 22 with successive manual axial mating, and twist locking actions. The rock screen 34 has a horizontally extending planar disc-shaped central filter portion 56 (FIG. 2) formed with a grid of small rectangular apertures suitably sized to prevent passage of small rocks and other debris that would otherwise damage the internal drive mechanisms of the sprinkler 10.

Each spring finger 50 is configured to function as a leaf spring whose outer end engages rigid structure in the outer case 18 beneath the rock screen 34 when the riser assembly 22 is rapidly retracted within the outer housing 18. The four spring fingers 50 collectively absorb the shock that would otherwise be transmitted to the drive mechanisms within the riser 22. Referring to FIG. 5 each spring finger 50 has a generally elongated rectangular shape with straight, slightly inclined, generally horizontal parallel top and bottom edges and a straight, slightly inclined, generally vertical outer edge. The spring members 50 are thus inclined relative to a plane normal or perpendicular to the central vertical axis of the riser assembly 20. The incline of the normally substantially parallel top and bottom edges of the spring finger 50 is preferably between about 2 degrees and 7 degrees. The bottom edge of each of the spring fingers 50 is formed with a foot 50*a* that engages the structure immediately beneath the finger 50 when the riser assembly 20 is rapidly retracted. The foot 50*a* provides a fulcrum that facilitates flexing of the spring finger 50 from its relaxed normal configuration illustrated in FIG. 6 to its deflected configuration illustrated in FIG. 7. The upper portion of the outer shape of the spring finger 50 is defined by a cut-out region 52*a* in the cylindrical wall 52 of the rock screen 34. The cut-out region 52*a* has a round portion at the inner end of the spring finger 50 to facilitate up and down flexing of the spring finger 50. The height of the cut-out region 52*a* allows sufficient upward flexing of the spring finger 50 to adequately absorb the shock generated during rapid retraction of the riser assembly 20. The thicknesses, materials and configuration of the spring finger 50 are chosen to meet the load requirements dictated by the force of the coil spring 40 that rapidly drives the riser assembly 20 downwardly inside the outer case 18. This frequently occurs during the winterization or the restarting of the irrigation system after winterization when there is only air in the sprinkler 10 and no water that would normally slow down the retraction of the riser assembly 20.

A removable diaphragm valve module 58 is mounted in the lower end of the outer case 18 and is held in position by a snap ring 60 that seats in an annular groove 62 formed on the interior surface of the outer case 18. Details of the construction of the diaphragm valve module 58 are illustrated disclosed in U.S. Pat. No. 7,303,147 granted Dec. 4, 2007, to Fred M. Danner et al. and assigned to Hunter Industries, Inc. and U.S. patent application Ser. No. 12/732,069 filed by Fred M. Danner et al. on Mar. 25, 2010, and assigned to Hunter Industries, Inc., the entire disclosures of both of which are hereby incorporated by reference. The diaphragm valve module 58 is configured for removal as a unit from the pop-up sprinkler 10 after removal of the riser assembly 20 and the snap ring 60. This allows for convenient repair or replacement of the valve module 58 without having to excavate the sprinkler 10. The valve seat in the valve module 58 can become damaged due to debris causing undesirable leakage of the sprinkler 10 from its nozzle. The elastomeric diaphragm in the valve module 58 can also become worn and need replacement. In addition it may be desirable to remove rocks from the conical-shaped rock screen 64 attached to the lower end of the valve module 58.

Figure 3:
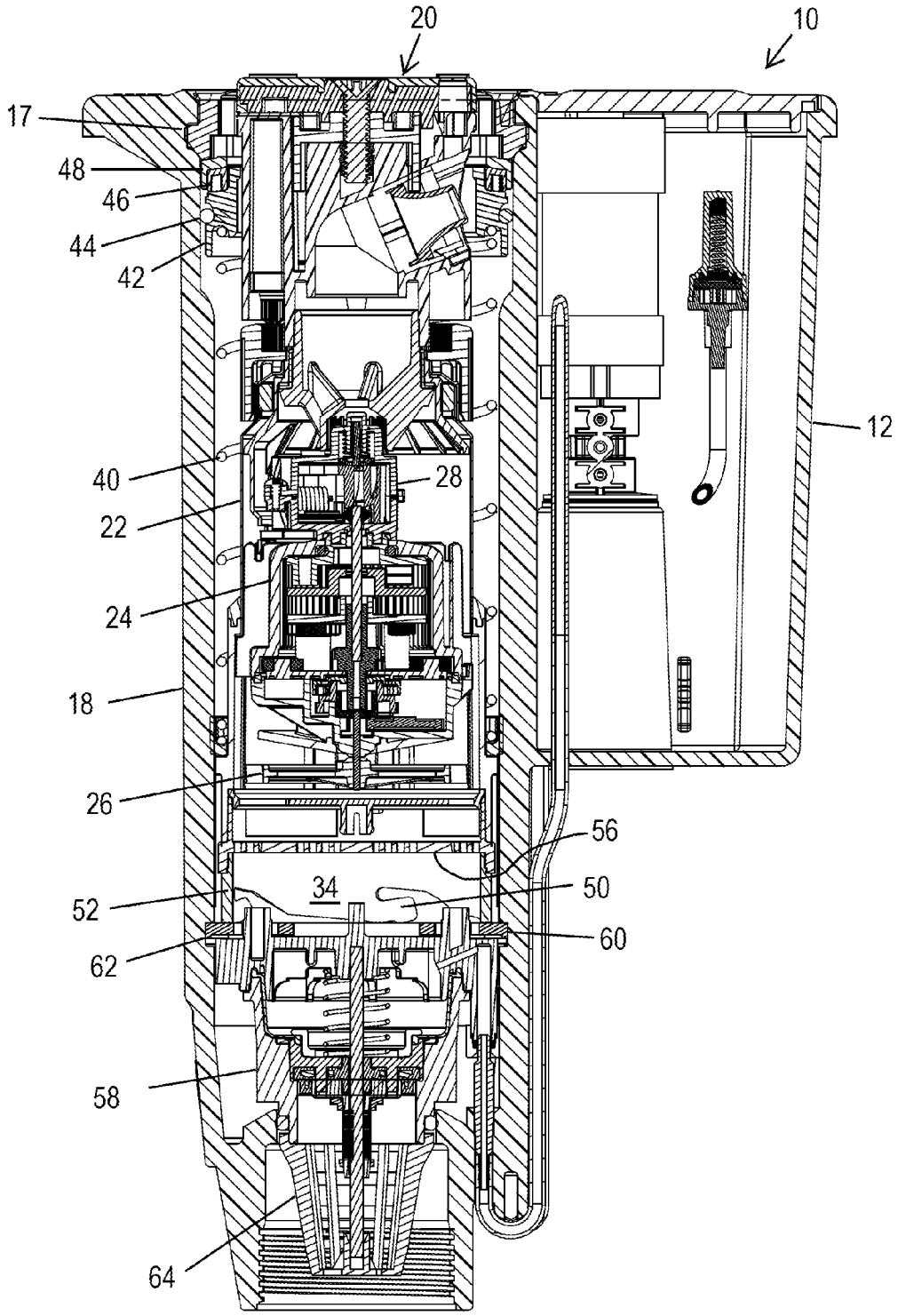
Figure 7:
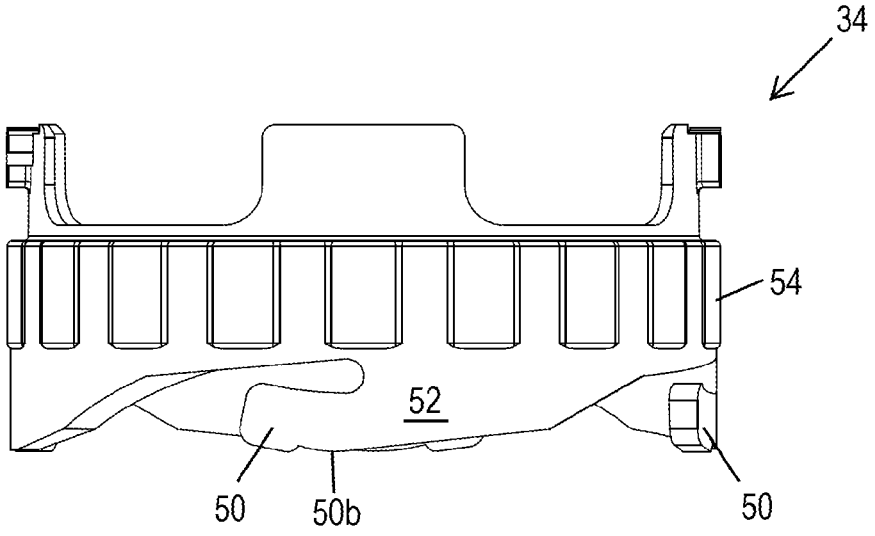
FIG. 7 is a view of the cylindrical screen similar to FIG. 6 except that the spring fingers are shown in their deflected configuration.

FIG. 2 illustrates the riser assembly 20 of the sprinkler is in its normal at rest retracted position within the outer case 18 of the sprinkler 10. In this configuration, the foot 50*a* of each spring finger 50 is engaged with the upper flat annular surface of the snap ring 60. Each spring FIG. 50 is then in its relaxed normal configuration illustrated in FIG. 6. During rapid retraction of the riser assembly 20 the force of the coil spring 40 forces the riser assembly downwardly at high velocity since its motion is unimpeded by the presence of water which would otherwise dampen the forces exerted by the compressed coil spring 40. FIG. 3 shows the riser assembly 20 in its further retracted position caused by its high speed retraction. In this view the spring fingers 50 at the lower end of the riser assembly 20 have been deflected upwardly to absorb the shock that the riser assembly 20 would otherwise be subjected to. The deflected configuration of the spring fingers 50 is illustrated in FIG. 7. The straight bottom edge of the spring finger 50 is now curved. The segment 50*b* of the bottom edge of the spring finger 50 acts as a stop so that the spring finger 50 does not flex past a predetermined maximum amount that would break the spring finger 50 or permanently impair its resilience, i.e. repetitive spring function. The dimensions, configuration, material and the resulting spring force or resilience of the spring finger 50 defines its predetermined maximum degree of flex or bending. Preferably during rapid retraction of the riser assembly 20 the outer edge of the spring finger 50 does not engage the lower edge of the cylindrical wall 52.

Figure 8:
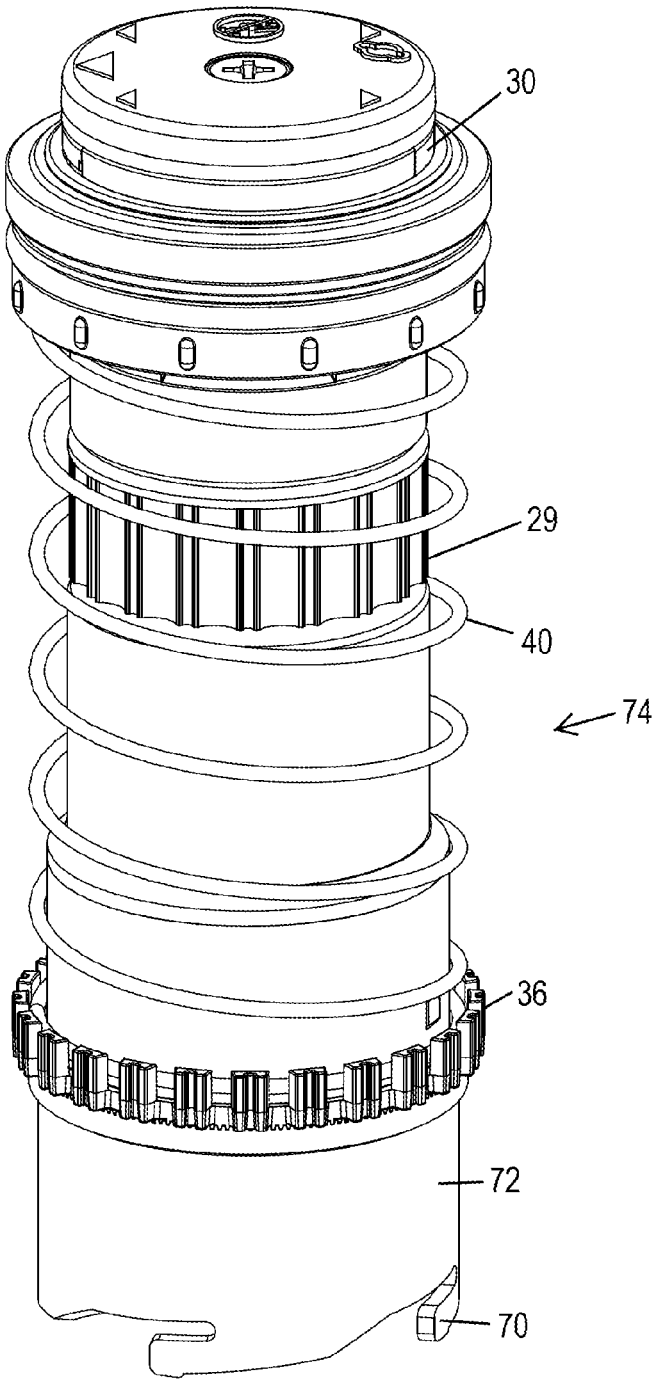
FIG. 8 is an isometric view of a riser assembly incorporating a second embodiment of the present invention in which the spring fingers are integrally formed at the lower end of the riser. The spring fingers are shown in their relaxed normal configuration.
Figure 9:
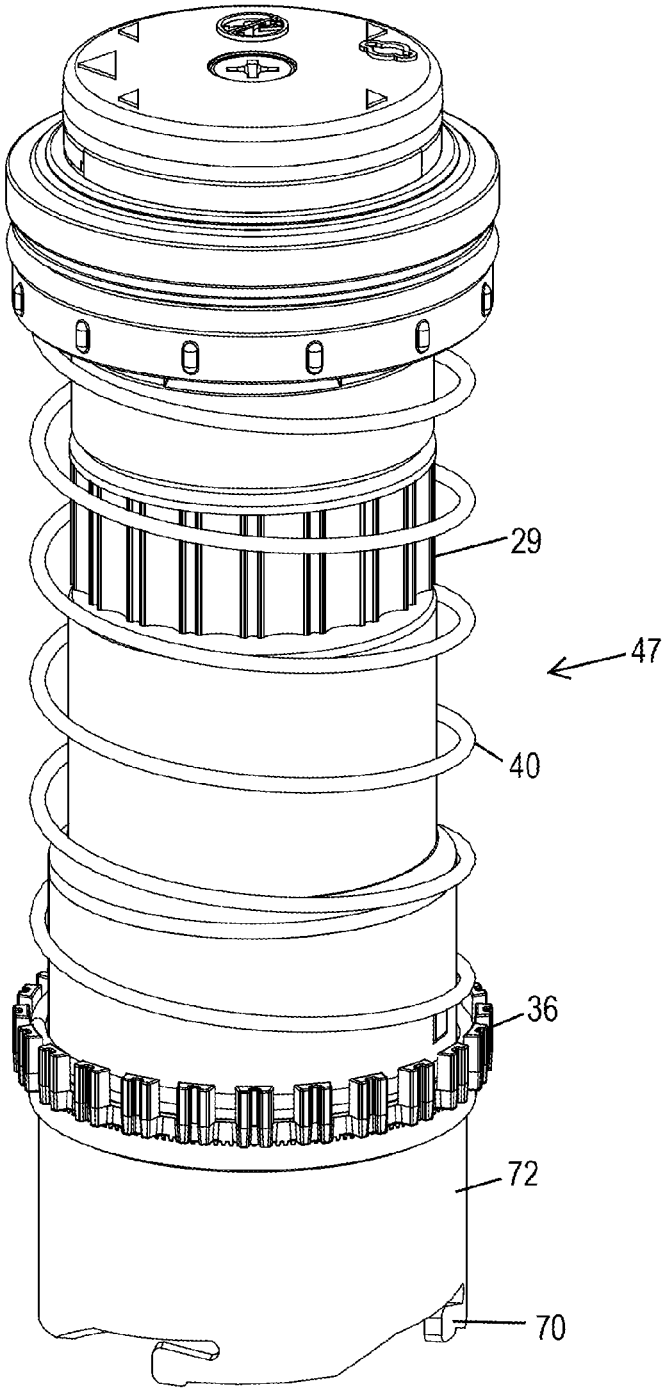
FIG. 9 is a view of the riser assembly of FIG. 8 showing the spring fingers in their deflected configuration.
Figure 10:
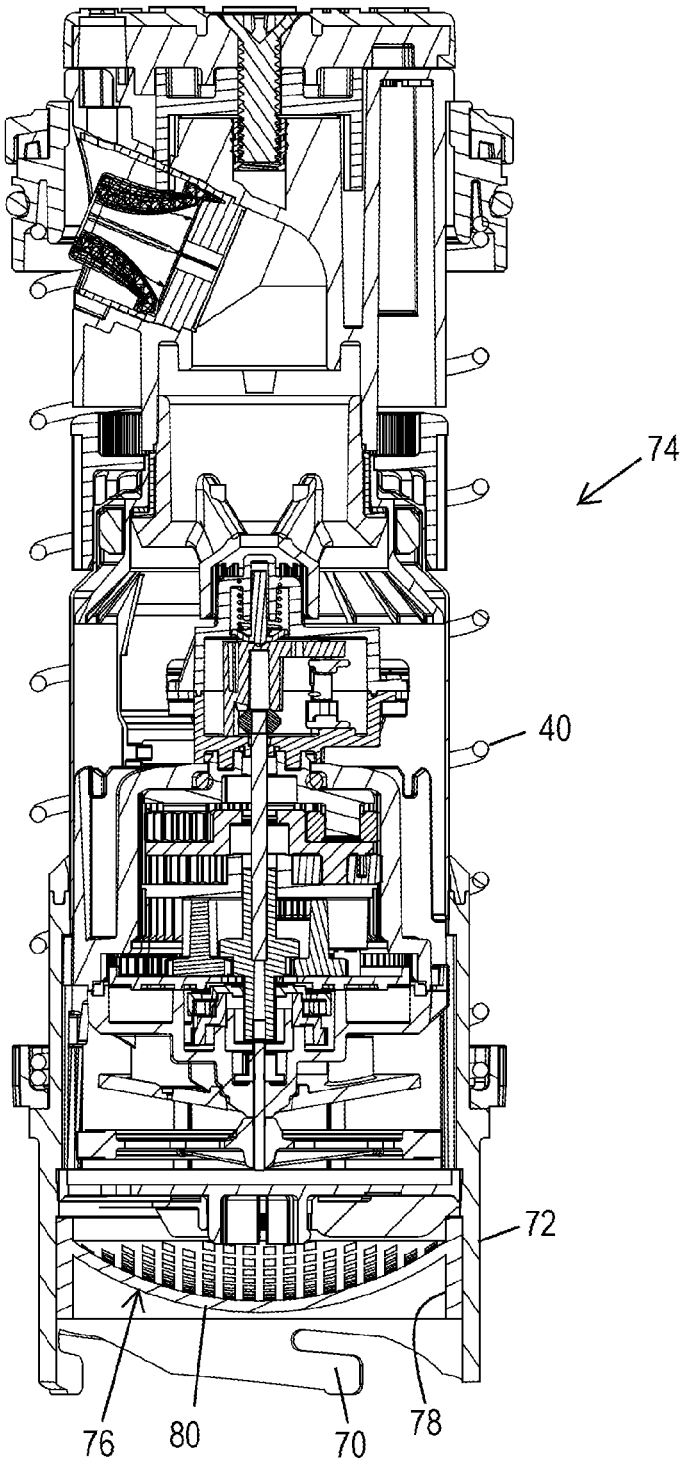
FIG. 10 is a vertical sectional view through the riser assembly of FIG. 8 showing details of its rock screen. The spring fingers are shown in their relaxed normal configuration.
Figure 11:
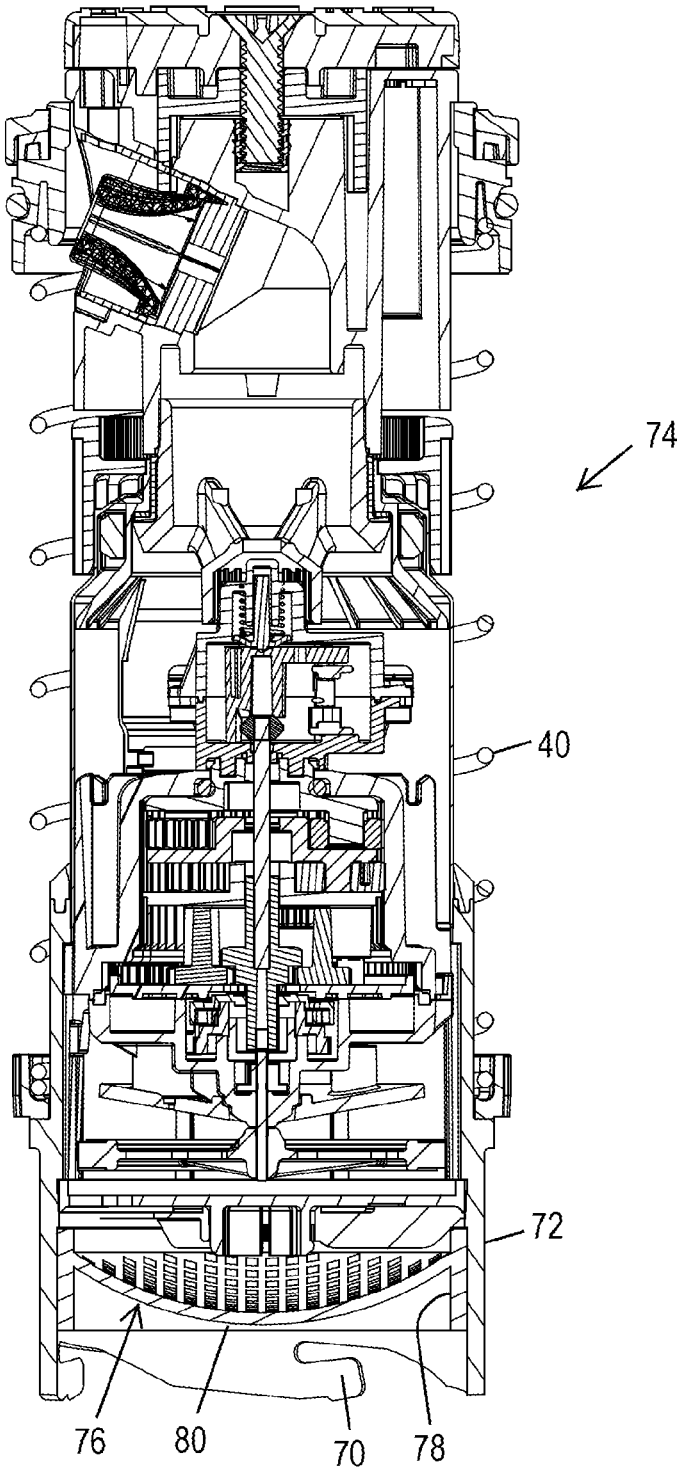
FIG. 11 is a view similar to FIG. 10 showing the spring fingers in their deflected configuration.

Referring to FIG. 8, in a second embodiment of the invention, the riser the spring fingers 70 are integrally formed in the lower end of the tubular riser 72 of the riser assembly 74. The spring fingers 70 are shown in their relaxed normal configuration in FIG. 8. FIG. 9 shows the spring fingers 70 in their deflected configuration. The second embodiment has a rock screen 76 (FIGS. 10 and 11) that is press fit into the bottom of the tubular riser 72. The rock screen 76 has a cylindrical outer wall 78 and a horizontally extending dome-shaped central filter portion 80. The filter portion 80 is concave on its upper side and convex on its lower side. The filter portion 80 is formed with a grid of small rectangular apertures suitably sized to prevent passage of small rocks and other debris that would otherwise damage the internal drive mechanisms of the sprinkler 10. The riser assembly 74 otherwise has a construction similar to that of the riser assembly 20 of the first embodiment.

While two embodiments of the present invention have been described and illustrated in detail, it will be apparent to those skilled in the art of designing irrigation sprinklers from the disclosure herein that the implementation of the present invention can be modified in both arrangement and detail. For example, the sprinkler may be a rotor-type sprinkler, a non-rotating sprinkler such as a spray type sprinkler, a programmable rotation sprinkler, an impact sprinkler, or any other type of irrigation sprinkler. The rock screen 34 could be formed with the domed shaped filter 80 and the rock screen 78 could be formed with the flat rock screen 56. The shock absorber need not be mounted on the lower end of the riser assembly or riser but could be mounted on top of a lower portion of the outer case as a separate part. The spring fingers could have co-molded outer portions made of softer plastic to provide increased cushioning. Other shock absorbers besides leaf springs could be used such as a coil spring, a wave spring washer, or a compressible elastomeric material. Therefore the protection afforded the present invention should only be limited in accordance with the following claims.

What is claimed is:

1. An irrigation sprinkler, comprising:

an outer case having an upstream end and a downstream end;

a riser having a downstream end and an upstream end and telescopically extensible from the outer case including a nozzle at the downstream end of the riser;

a coil spring surrounding the riser and normally holding the riser in a lower retracted position within the outer case, the coil spring being dimensioned and configured to permit extension of the riser to a raised upper position when pressurized water is introduced into the outer case; and a shock absorber comprising at least one spring member;

the shock absorber positioned between a lower-most upstream end of the riser and a rigid structure in the upstream end of the case for lessening the forces otherwise exerted on the riser during rapid retraction of the riser.

2. The sprinkler of claim 1 wherein the shock absorber is mounted to the upstream end of the riser.

3. The sprinkler of claim 2 wherein the shock absorber is formed on a rock screen that is mounted on the upstream end of the riser.

4. The sprinkler of claim 1 wherein shock absorber includes a plurality of spring members.

5. The sprinkler of claim 4 wherein the spring members are configured as leaf springs.

6. The sprinkler of claim 5 wherein the leaf springs are inclined relative to a plane normal to a central axis of the riser.

7. The sprinkler of claim 6 wherein spring members are inclined at an angle of between about 2 degrees and about 7 degrees.

8. The sprinkler of claim 4 wherein the spring members are uniformly spaced around a circumference of the upstream end of the riser.

9. The sprinkler of claim 4 wherein the spring members are each formed with a foot that serves as a fulcrum.

10. The sprinkler of claim 1 wherein the rigid structure in the upstream end of the case is a snap ring.

11. The sprinkler of claim 1, comprising a nozzle turret rotatably mounted at the downstream end of the riser, an internal drive mechanism mounted in the riser and coupled to the nozzle turret, the internal drive mechanism including a turbine, a gear train reduction coupled to the turbine, and a reversing mechanism coupled to the gear train reduction.

12. An irrigation sprinkler, comprising:

an outer case having an upstream end and a downstream end;

a riser assembly having an upstream end and a downstream end and including a riser telescopically extensible from the outer case, a nozzle turret rotatably mounted at the downstream end of the riser, and an internal drive mechanism mounted in the riser and coupled to the nozzle turret;

a coil spring surrounding the riser assembly and normally holding the riser assembly in a lower retracted position within the outer case, the coil spring being dimensioned and configured to permit extension of the riser assembly to a raised upper position when pressurized water is introduced into the outer case; and at least one leaf spring extending downward from the upstream end of the riser for absorbing shock that would otherwise be transmitted to the internal drive assembly upon rapid retraction of the riser.

13. The sprinkler of claim 12 wherein the at least one leaf spring is formed on a rock screen that is mounted on the upstream end of the riser assembly.

14. The sprinkler of claim 12 wherein the sprinkler comprises a plurality of leaf springs extending downward from the upstream end of the riser, and wherein the leaf springs are uniformly spaced around a circumference of the upstream end of the riser assembly.

15. The sprinkler of claim 14 wherein the spring members are inclined relative to a plane normal to a central axis of the riser.

16. The sprinkler of claim 14 wherein the spring members are integrally formed on a the upstream end of the riser.

17. The sprinkler of claim 14 wherein the spring members are formed on a rock screen that is removably mounted to the the upstream end of the riser.

18. The sprinkler of claim 12, wherein the internal drive mechanism comprises a turbine, a gear train reduction coupled to the turbine, and a reversing mechanism coupled to the gear train reduction.

19. An irrigation sprinkler, comprising:

an outer case having an upstream end and a downstream end;

a riser assembly having an upstream end and a downstream end and including a tubular riser telescopically extensible from the outer case when pressurized fluid is introduced into the outer case; and a cylindrical wall mounted to a upstream end of the riser, the cylindrical wall having a plurality of integrally formed circumferentially spaced spring fingers extending downward from the upstream end of the riser assembly, the spring fingers configured to absorb shock when brought into contact with the outer case or with a fixed structure in the outer case during retraction of the riser assembly.

20. The sprinkler of claim 19, comprising a coil spring surrounding the riser assembly and normally holding the riser assembly in a lower retracted position within the outer case, the coil spring being dimensioned and configured to permit extension of the riser assembly to a raised upper position when pressurized water is introduced into the outer case.

21. The sprinkler of claim 19, wherein the riser assembly comprises a cylindrical nozzle turret rotatably mounted at the downstream end of the riser, and an internal drive mechanism mounted in the riser and coupled to the nozzle turret, the internal drive mechanism including a turbine, a gear reduction mechanism operably coupled with the turbine, and a reversing mechanism operably coupled with the gear reduction mechanism.

22. The sprinkler of claim 19, comprising a central filter portion connected to the cylindrical wall.

* * * * *